US007836615B2

(12) United States Patent
Winter

(10) Patent No.: US 7,836,615 B2
(45) Date of Patent: Nov. 23, 2010

(54) ROAD MACHINERY BLADE WEAR RESISTORS

(75) Inventor: Kent Winter, Willoughby, OH (US)

(73) Assignee: Winter Equipment Company, Willoughby, OH (US)

( * ) Notice: Subject to any disclaimer, the term of this patent is extended or adjusted under 35 U.S.C. 154(b) by 179 days.

(21) Appl. No.: 11/789,501

(22) Filed: Apr. 25, 2007

(65) Prior Publication Data

US 2008/0263907 A1 Oct. 30, 2008

(51) Int. Cl.
*E01H 5/06* (2006.01)

(52) U.S. Cl. ..... 37/270; 37/460; 37/903

(58) Field of Classification Search ..... 37/270, 37/460, 903

See application file for complete search history.

(56) References Cited

U.S. PATENT DOCUMENTS

| | | | | | |
|---|---|---|---|---|---|
| 1,904,201 | A | * | 4/1933 | William | 37/272 |
| 1,922,917 | A | * | 8/1933 | Charles et al. | 172/701.3 |
| 1,927,818 | A | * | 9/1933 | Brodersen | 299/105 |
| 1,930,862 | A | * | 10/1933 | Ross | 37/231 |
| 2,051,234 | A | * | 8/1936 | Wiese | 172/719 |
| 2,138,783 | A | * | 11/1938 | Clark et al. | 37/270 |
| 2,202,309 | A | * | 5/1940 | Campbell | 280/28 |
| 2,593,025 | A | * | 4/1952 | Hanson et al. | 280/28 |
| 2,611,979 | A | * | 9/1952 | Weller | 37/270 |
| 2,629,944 | A | * | 2/1953 | Arps | 37/231 |
| 3,010,230 | A | * | 11/1961 | Willard | 37/270 |
| 3,217,431 | A | * | 11/1965 | Heinzroth et al. | 37/270 |
| 3,286,379 | A | * | 11/1966 | Benetti | 37/452 |
| 3,732,939 | A | * | 5/1973 | Samson | 280/28 |
| 3,805,423 | A | * | 4/1974 | Engel et al. | 37/453 |
| 3,845,577 | A | * | 11/1974 | Naymik | 37/231 |
| 3,850,440 | A | * | 11/1974 | Reedy et al. | 280/28 |
| 4,050,170 | A | | 9/1977 | Proehl | |
| 4,129,952 | A | * | 12/1978 | Olson | 37/444 |
| 4,250,760 | A | | 2/1981 | Garries | |
| 4,315,375 | A | * | 2/1982 | Shinn | 37/460 |
| 4,346,528 | A | | 8/1982 | Shwayder | |
| 4,441,266 | A | * | 4/1984 | Westimayer | 37/244 |
| 4,476,642 | A | | 10/1984 | Hemphill | |
| 4,500,766 | A | * | 2/1985 | Reinhardt | 219/76.1 |
| 4,607,781 | A | * | 8/1986 | Shwayder | 228/175 |
| 4,709,492 | A | * | 12/1987 | Watson | 37/232 |
| 4,711,503 | A | | 12/1987 | Berchem | |
| 4,756,102 | A | | 7/1988 | Chapman | |
| 4,833,801 | A | | 5/1989 | Winter | |
| 4,899,472 | A | | 2/1990 | Winter | |
| 4,933,240 | A | * | 6/1990 | Barber, Jr. | 428/608 |

(Continued)

FOREIGN PATENT DOCUMENTS

| | | | |
|---|---|---|---|
| JP | 62099527 | A * | 5/1987 |

*Primary Examiner*—Thomas A Beach
(74) *Attorney, Agent, or Firm*—Fay Sharpe LLP; Karl W. Hauber

(57) ABSTRACT

Wear resistors adapted for use in wear parts comprising steel castings for replaceable attachment to snow plows, road machinery equipment, agriculture, and construction excavator teeth. The wear castings provide a replaceable member for wear affected parts of equipment used for cutting, scraping, digging, plowing, etc. Each replaceable wear part can comprise a hard, impact resistant metal of high shear strength having at least one cavity filled with an abrasion resistant weldment or resistor. The abrasion resistant weldment can be placed proximal to the wear edges or wear surfaces of the expendable and replaceable wear parts.

20 Claims, 6 Drawing Sheets

U.S. PATENT DOCUMENTS 5,081,774 A 1/1992 Kuwano
5,111,600 A * 5/1992 Lukavich et al. ..... 37/452
5,210,965 A 5/1993 Funk
5,375,350 A 12/1994 Maybon
5,636,458 A 6/1997 Drake
5,647,448 A 7/1997 Skaggs
5,743,033 A 4/1998 Gegel
5,946,830 A 9/1999 Ostermeyer
6,000,117 A * 12/1999 Bain ..... 29/458
6,240,662 B1 6/2001 Borowiak
6,269,559 B1 8/2001 Edwards
6,457,269 B1 10/2002 Esterhuyse
6,571,493 B2 6/2003 Amano
6,832,443 B1 12/2004 Piel et al.
6,854,808 B2 2/2005 Kostecki

* cited by examiner

ROAD MACHINERY BLADE WEAR RESISTORS

BACKGROUND

This application relates to snow plows, agriculture equipment, construction excavator teeth, and other road machinery, and more specifically to guards, and wear resistors for the wear surfaces, i.e. blades and teeth, thereof.

Usually the heavy steel cutting or wear edges of blades, teeth, and skid shoes are expendable and can be removable, e.g., with bolts, to the bottom of, for example, a plow moldboard, backhoe bucket, grinder wheel, etc. As a blade scrapes along the pavement or ground it wears. The wear often is uneven, and the blades and teeth (cutting edges) sometimes break during plowing, digging, scraping, etc. All this maintenance and the associated downtime are costly.

The blade on typical snow plowing machines is subjected to extensive vibration, impact, and abrasive action, resulting from the scraping action between the cutting edge of the blade and the roadbed over which the machine travels. As a result, the blade edge wears and chips due to the road abrasion and impact and must be replaced every few hours. This is a costly proposition because of the down time of the machine and cost expended in manpower and materials to make a blade changeover.

It is conventional to provide to the plow or plow attachment frame caster-like wheels, mushroom shoes, or wear skid shoes which are attached to, but spaced from, the plow moldboard for the purpose of supporting part of the load on the blade. These known prior art devices are relatively bulky, expensive to manufacture, and difficult to install on the snow plow. The cast iron material typically used on the wear shoes does not provide protection against fracturing or breakage, due to the relative brittleness of cast iron, when the shoes are subjected to impacts. The shoes are expensive to maintain and replace.

Thus, there has been a need for an improved means which supports the cutting edge of, for example, a snow plow blade from the roadbed for reducing or dampening the undesirable vibrating, impact and abrasive action on the blade. The disadvantages of present wear shoe constructions have resulted in the improved skid shoe-wear surface of the present disclosure which effectively reduces blade wear and shoe replacement resulting from road abrasion. Furthermore, the present disclosure can increase blade (cutting edge) life, skid shoe life, reduce blade breakage and maintenance, and protect the moldboard, bucket or similar mounted thereto.

In one embodiment, the present disclosure relates to a skid shoe for a snow plow blade, and more particularly, to a shoe which is bolted to the plow moldboard at the pre-existing bolt holes used to fasten the blade to the moldboard. Alternatively, the skid shoe can be mounted to the plow attachment frame. The skid shoe can include a wear surface including an abrasion resistant welding deposit filling one or more cavities along, and integrated with, the wear surface. In other embodiments, the present disclosure provides wear resistors embedded within blades and teeth for improved wear resistance along the associated cutting edges.

SUMMARY

One aspect of this disclosure provides an expendable wear part adapted for replaceable attachment to, for example, a snow plow blade or other mounting attachment of an associated component of road machinery. The wear part comprises a steel casting having a mounting surface and a wear surface.

The wear surface has at least a first cavity extending along and below the wear surface. The at least first cavity includes an abrasion-resistant welding deposit therein for extending the service life of the wear surface of the wear part. The deposit comprises a weldment material selected from the group consisting of chrome carbide, vanadium carbide, and tungsten carbide. The weldment material can have a higher hardness than the steel casting.

Another aspect of the disclosure provides for an expendable wear part adapted for replaceable attachment. The wear part comprises a steel casting. The wear part includes a direction of travel when in an engaged position. The steel casting includes a wear surface having a plurality of cavities extending along the wear surface. The plurality of cavities each have an abrasion-resistant welding deposit therein. The welding deposit has a higher hardness than the steel casting. The welding deposits in the plurality of cavities overfills the cavities and forms substantially parallel bulbous deposits adjacent to and extending outwardly from the wear surface of the casting. The deposits can be longitudinally aligned with, or transverse to, the direction of travel.

Yet another aspect provides a method for extending the life of an expendable wear part adapted for replaceable attachment. The method comprises casting a steel wear part having a plurality of cavities extending longitudinally along a wear surface of the wear part. The method further comprises welding a series of abrasion resistant deposit layers in the cavities wherein the layers are spaced from one another and run along the majority of the length of the wear surface of the casting and wherein the deposit layers have a higher hardness than the steel casting wear part. The cavities can be aligned with, or transverse to, a direction of travel of the wear part when the wear part is in an engaged and use position.

DETAILED DESCRIPTION

Figure 1:
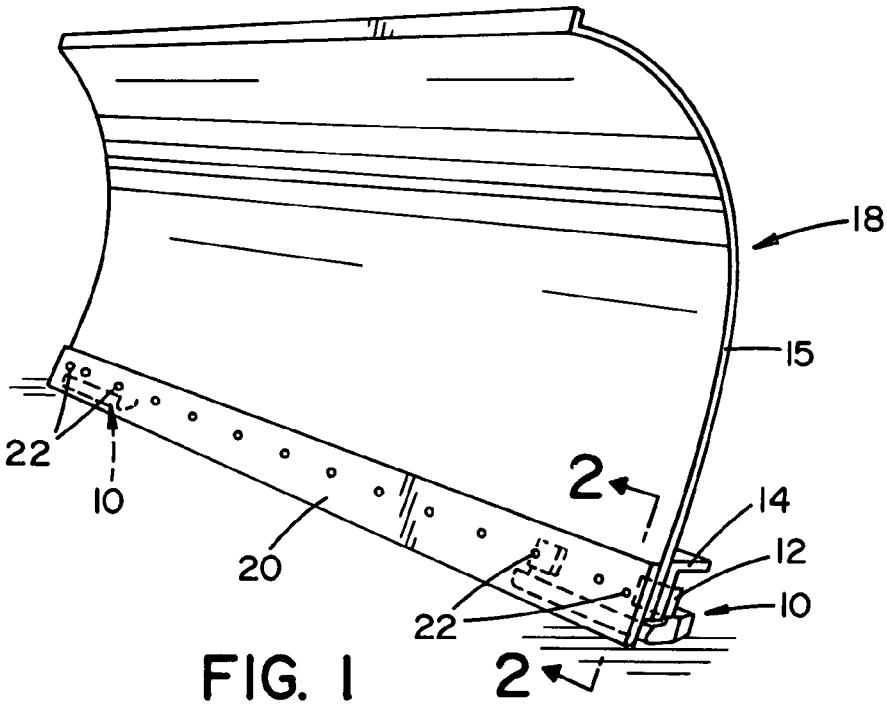
FIG. 1 is a perspective view of a snow plow blade equipped with a pair of skid shoe-wear resistor combinations of the present disclosure according to a first embodiment.
Figure 2:
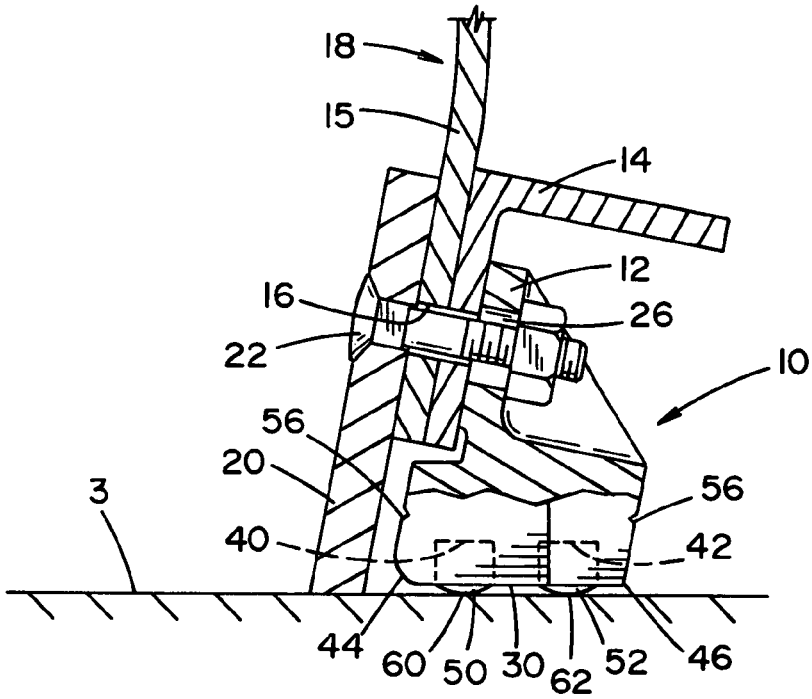
FIG. 2 is a cross sectional view of the skid shoe taken along line 2-2 of FIG. 1.
Figure 3:
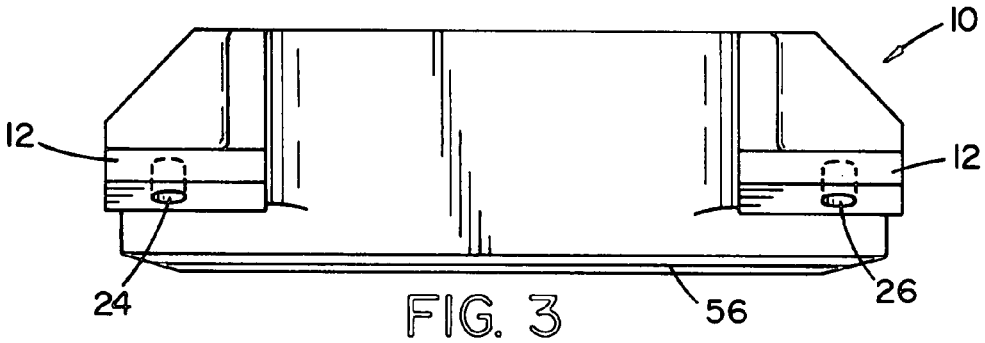
FIG. 3 is a top plan view of the skid shoe according to the first embodiment.
Figure 4:
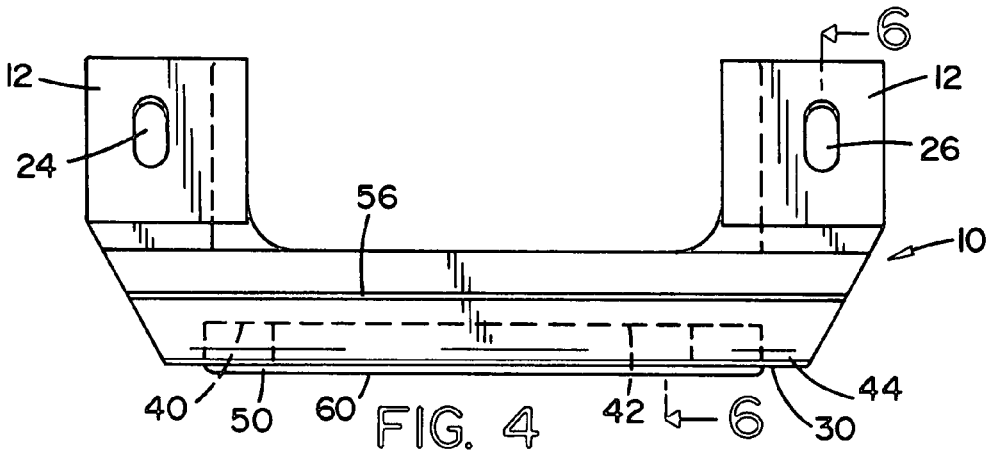
FIG. 4 is a front elevational view of the skid shoe FIG. 3.

In a first embodiment, the wear resistant surface made in accordance with the teachings of the present disclosure is illustrated in FIGS. 1-6. A skid or moldboard shoe 10 can be used to reduce the extensive vibration, impact, and abrasive action between the cutting edge of a snow plow blade and the associated skid shoes along the roadbed 3 over which the snow plow travels. In one mounting arrangement, a pair of skid shoes or moldboard shoes 10 can be mounted on opposite ends of the blade, as illustrated in FIG. 1.

The skid shoe 10, according to a first embodiment, includes a mounting plate 12 which is secured to the backside of a conventional snow plow blade 18 at the pre-existing bolt holes 16 used to fasten a cutting edge 20 and a moldboard 15 such that shoe 10 can be mounted close to the cutting edge 20 of snow plow blade 18. One of the advantages of the moldboard shoe 10 is that it can be mounted to mounting structure 14 using longer bolts 22 and the same bolt openings 16 which are used in securing cutting edge 20 to moldboard 15. Thus, the present construction eliminates complicated and bulky supporting structure for the skid shoe 10, thereby reducing the time and cost of fitting the skid shoe 10 onto the snow plow blade 18. Further, the bolts 22 for mounting moldboard 15, moldboard shoe 10 and structure 14 become shock and impact absorbers for the cutting edge 20 of snow plow blade 18.

It is to be appreciated that the bolt mounting openings 16 for snow plow blade 18 are located along moldboard 14 at standard spacings of 8-inch or 12-inch centers. As shown, the mounting plate 12 includes a set of spaced apart mounting openings 24 and 26, respectively, such that moldboard shoe 10 may be mounted to the snow plow blade 18 having a 12-inch bolt hole center. Other standard mounting hole spacings are also within the scope of the present disclosure.

The moldboard shoe 10 further includes a generally horizontal skid or wear surface 30. One or more cavities 40, 42 are cast into the moldboard shoe 10 at the time of casting. The moldboard shoe 10 can be cast from steel for greater strength and resiliency.

In one mounting arrangement, the skid shoe 10 resides close to the blade cutting edge 20 and thus is a more integral part of the blade 18 and, therefore, capable of absorbing more of the undesirable abrasive wear.

The steel casting can take on the following analysis (balance iron).

| C | Mn | P | S | Si | Cr | B | Hardness Bhn |
|---|---|---|---|---|---|---|---|
| ×100<br>16 | ×100<br>140 | ×1000<br>16 | ×1000<br>16 | ×100<br>525 | ×100<br>26 | ×100<br>0.4 | 363/401 |

The greater the impact resistance, shear strength, and hardness of the panel sections, generally the better. Accordingly, armor steel castings can be used, typically ones with high chromium, carbon and silicon contents. Other armor steels, quenched and tempered ultraservice steels, and maraging steels also are useful here. The casting process can include the provision of one or more cavities 40, 42 in association with the wear surface 30.

Figure 6:
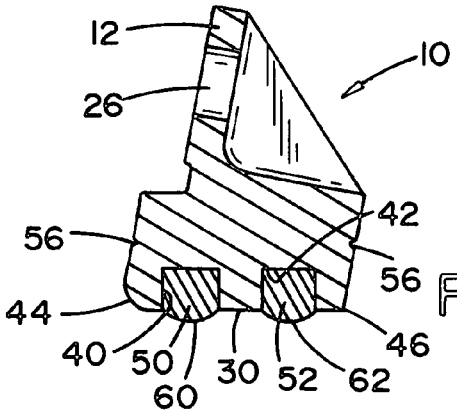
FIG. 6 is a cross sectional view of the skid shoe taken along line 6-6 of FIG. 4.

Subsequent to casting, the cavities 40, 42 can be filled and/or overfilled by welding therein a layered carbide matrix. The layered carbide matrix can be composed of a series of layered deposits 50, 52, one on top of another until the cavity is filled or overfilled. Overfilling the cavity can result in a convex or bulbous layer 60, 62 of carbide matrix terminating beyond, i.e. extending below, the wear surface 30 of the shoe 10. The matrix provides a reconstitutable embedded weldment or resistor 50, 52 for increased wear resistance of the wear surface 30. In one exemplary embodiment, the two longitudinal cavities 40, 42 extend along substantially the length of the wear surface 30. The cavities 40, 42 can be spaced from one another and proximal to opposing edges 44, 46, respectively, of the shoe 10. Referring now to FIG. 6, there is shown a wear termination or replacement line 56. The wear replacement line 56 indicates when the shoe 10 should be replaced. The wear line 56 can be reached, for example, when all, or substantially all, of the carbide matrix has worn off which can correspond to approximately 25% of wear of the steel casting skid shoe 10.

The weldments 50, 52 can comprise a weight of between 1 and 4 pounds. The weldments 50, 52 can increase the weight of each shoe from about 5% to about 20%. The plurality of weldments 50, 52 can be aligned with the wear surface 30 such that when the plow is in use and traveling along the road surface, the weldments 50, 52 are transverse to the direction of travel. Alternatively, the weldments can be aligned such that they are aligned with the direction of travel.

The weld deposits 50, 52 can have the following analysis (balance iron):

| C | Cr | Mo | Si | Mn | Hardness/Rc 55-60 |
|---|---|---|---|---|---|
| ×100<br>2.60 | ×100<br>12.00 | ×100<br>0.62 | ×100<br>1.37 | ×100<br>0.77 | |

Conventional hard-facing or wear-facing weldments can be used for the deposits. So-called chrome carbide steels are the most common, e.g., Stoody Company No. 121, although vanadium carbide (Stoody No. 134) and tungsten carbide ones also can be used very effectively. It is to be appreciated that the weldment material deposited in the cavity has a higher hardness than the steel casting.

The weldment metal must be abrasion-resistant. Generally, it is a high chrome ferrous metal weld. It is reconstitutable in the sense that it can be repaired or replaced by redeposition of carbide matrix by welding.

The wear surface 30 and the embedded or integrated weldments 50, 52 help to support the cutting edge 20 of the blade such that the abrasive action and impact from the roadbed 3 works on the wear surface 30 and weldments 50, 52 of the skid or moldboard shoes 10 instead of the blade cutting edge 20, thereby substantially prolonging the life of the cutting edge 20. In addition, the weldments 50, 52 substantially prolong the life of the associated shoe 10 due to the wear surface 30 being a combination of carbide matrix and steel casting. The present wear resistors are intended to perform better than mechanically fastened solid carbide bars would under the extreme conditions of vibration, impact and thermal shock experienced by snow plow blades.

Figure 9:
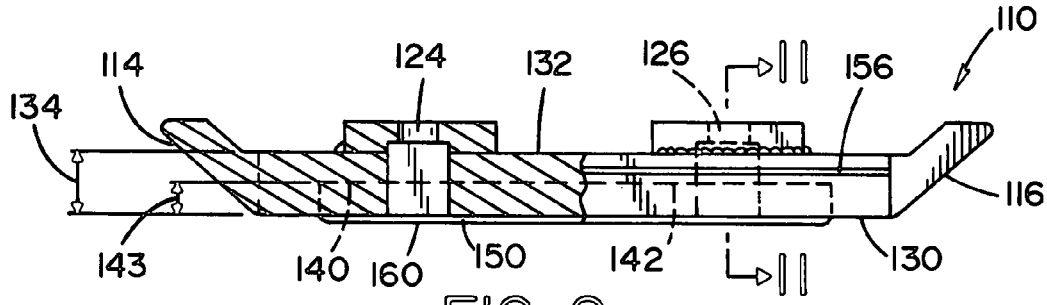
FIG. 9 is a partial cross sectional side view of the skid shoe according to the second embodiment.

FIGS. 7-11 show another embodiment of the skid shoe 110. This shoe 110 is a rectilinear shoe with angled fore and aft surfaces 114, 116 and a planar bottom wear surface 130. A pair of cavities 140, 142 are shown with weldments 150, 152 deposited therein. Referring now to FIG. 9, there is shown a wear termination or replacement line 156. The wear replacement line 156 indicates when the shoe 110 should be replaced. The wear line 156 can be reached, for example, when all, or substantially all, of the carbide matrix has worn off which can correspond to approximately 25% of wear of the steel casting skid shoe 110.

The surface area of the weldments 150, 152 can comprise from about 20% to about 30% of the total surface area of the bottom wear surface 130.

Figure 7:
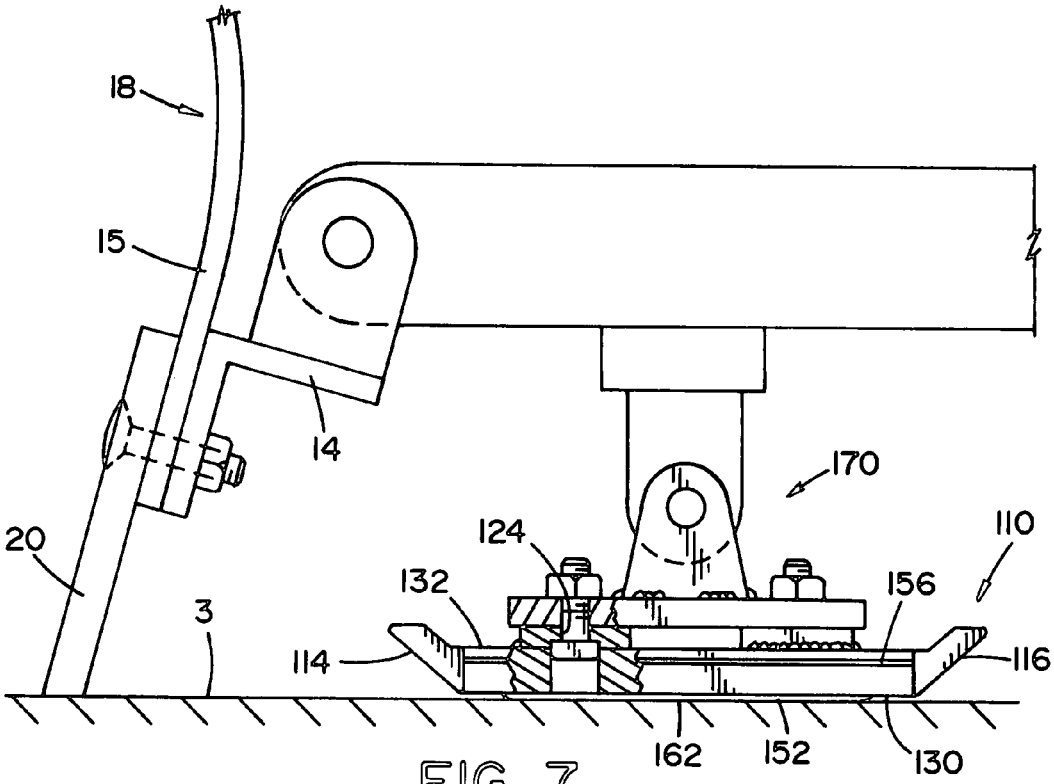
FIG. 7 is a side plan view of a snow plow blade and frame attachment equipped with a skid shoe wear resistor of the present disclosure according to a second embodiment.
Figure 8:
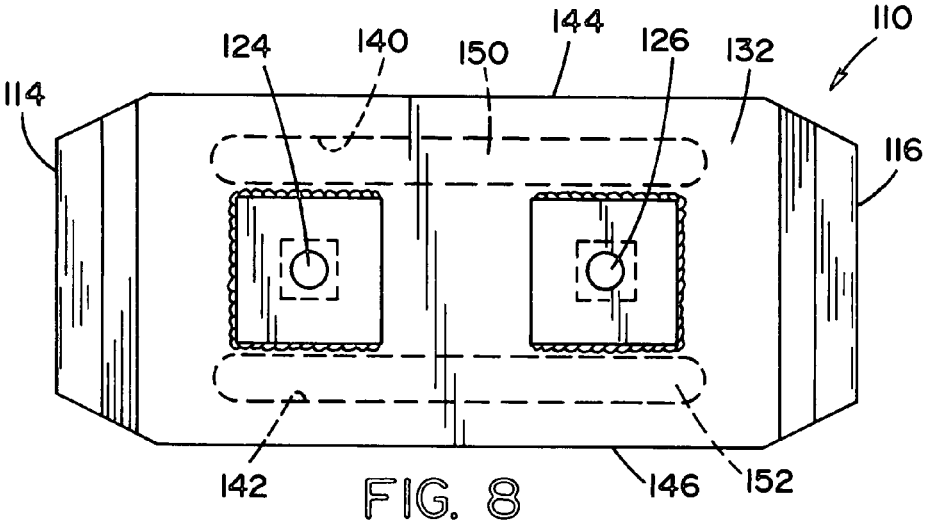
FIG. 8 is a top plan view of the skid shoe according to the second embodiment.

The expendable wear parts or shoes I 10 are adapted for replaceable attachment to, for example, a snow plow mold board or snow plow mounting arrangement 170 (FIG. 7). The at least first cavity 140 can include an abrasion-resistant welding deposit 150 therein for extending the service life of the wear surface 130 of the wear part. The wear part can include the second cavity 142 substantially aligned with the first cavity 140. The second cavity 142 can include the abrasion-resistant welding deposit 152 therein for further extending the service life of the wear surface 130. The welding deposits can comprise the matrix structure as described above. The cavities 140, 142 can be refilled in order to extend the life of the wear part. In this manner, the weldments 150, 152 can be reconstituted before the wear surface 130 reaches the wear line 156. The first and second cavities can be substantially parallel to one another.

It is to be appreciated that skid shoe 110 includes a set of spaced apart mounting openings 124 and 126 such that shoe 110 may be mounted to the snow plow mounting frame 170. Other standard mounting hole spacings and arrangements are also within the scope of the present disclosure.

Figure 10:
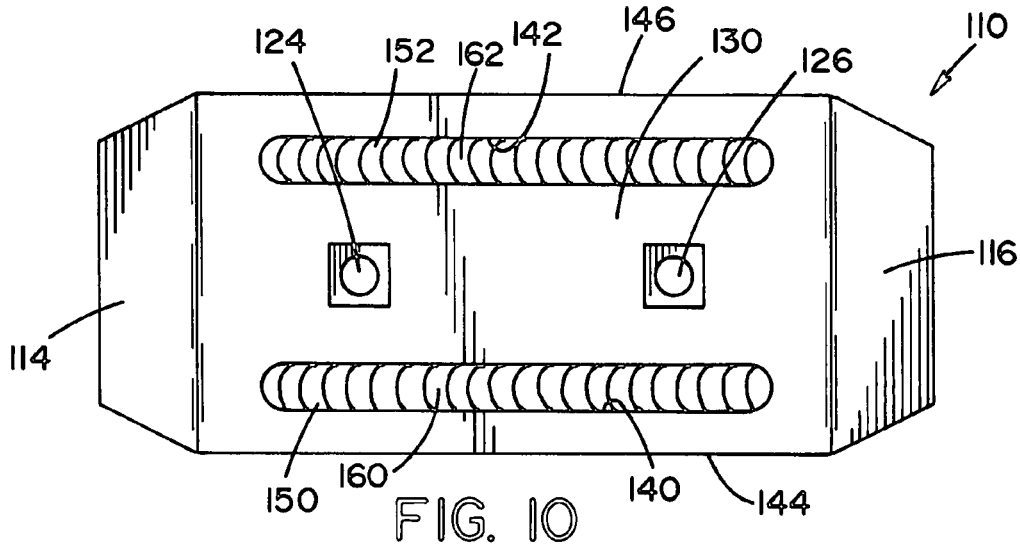
FIG. 10 is a bottom plan view of the skid shoe wear resistor illustrating the spatial relationship between the wear surface and the wear resistors.
Figure 11:
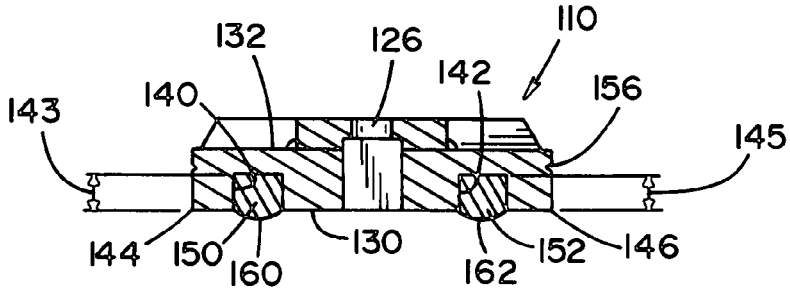
FIG. 11 is a cross sectional view of the skid shoe taken along line 11-11 of FIG. 9.

The welding deposits 150, 152 in the first and second cavities 140, 142 can overfill the cavities forming substantially parallel bulbous deposits 160, 162 extending outwardly from the wear surface 130 of the casting (see FIG. 11). The first and second cavities 140, 142 can be spaced from one another and run along the majority of the length of the wear surface 130 of the casting (refer to FIG. 10). The cavities 140, 142 can be proximal to opposing edges 144, 146, respectively, of the shoe 110.

The wear part 110 can include a thickness 134 between the wear surface 130 and an upper surface 132 of the shoe 110. The first and second cavities 140, 142 can include a depth 143, 145 wherein the depth is at least one half of the thickness 134 of the wear part 110.

In one exemplary shape, the essentially flat or panel portion of each shoe 110, as shown in FIGS. 7-11, can be about 12 inches long, 7 inches wide, and 1¼ inch thick armor steel It is to be appreciated that other embodiments can take the form of other shapes and other dimensions.

Figure 14:
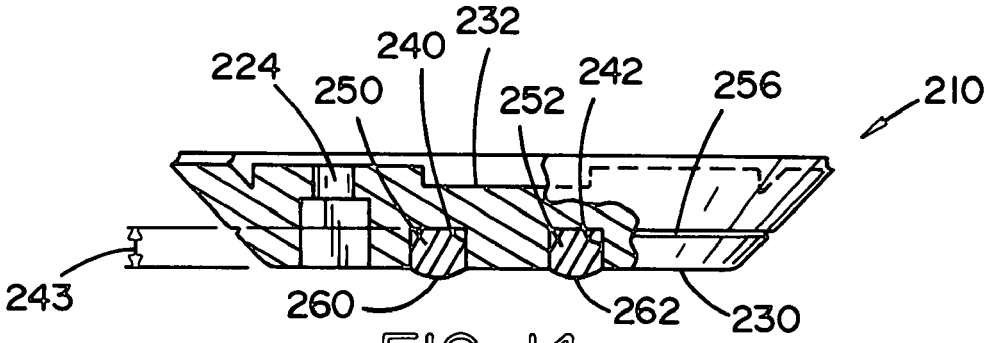
FIG. 14 is a partial cross sectional side view of the skid shoe taken along line 14-14 of FIG. 13.

In another exemplary embodiment (FIGS. 12-16), a so-called mushroom skid shoe 210 is shown. This shoe 210 comprises a circular shape with a circumferential bottom wear surface 230. A pair of cavities 240, 242 are shown with weldments 250, 252 deposited therein. Referring now to FIG. 14, there is shown a wear termination or replacement line 256. The wear replacement line 256 indicates when the shoe 210 should be replaced. The wear line 256 can be reached, for example, when all, or substantially all, of the carbide matrix is worn off which can correspond to approximately 25% of wear of the steel casting skid shoe 230.

The surface area of the weldments 250, 252 can comprise from about 20% to about 30% of the total surface area of the bottom wear surface 230.

Figure 12:
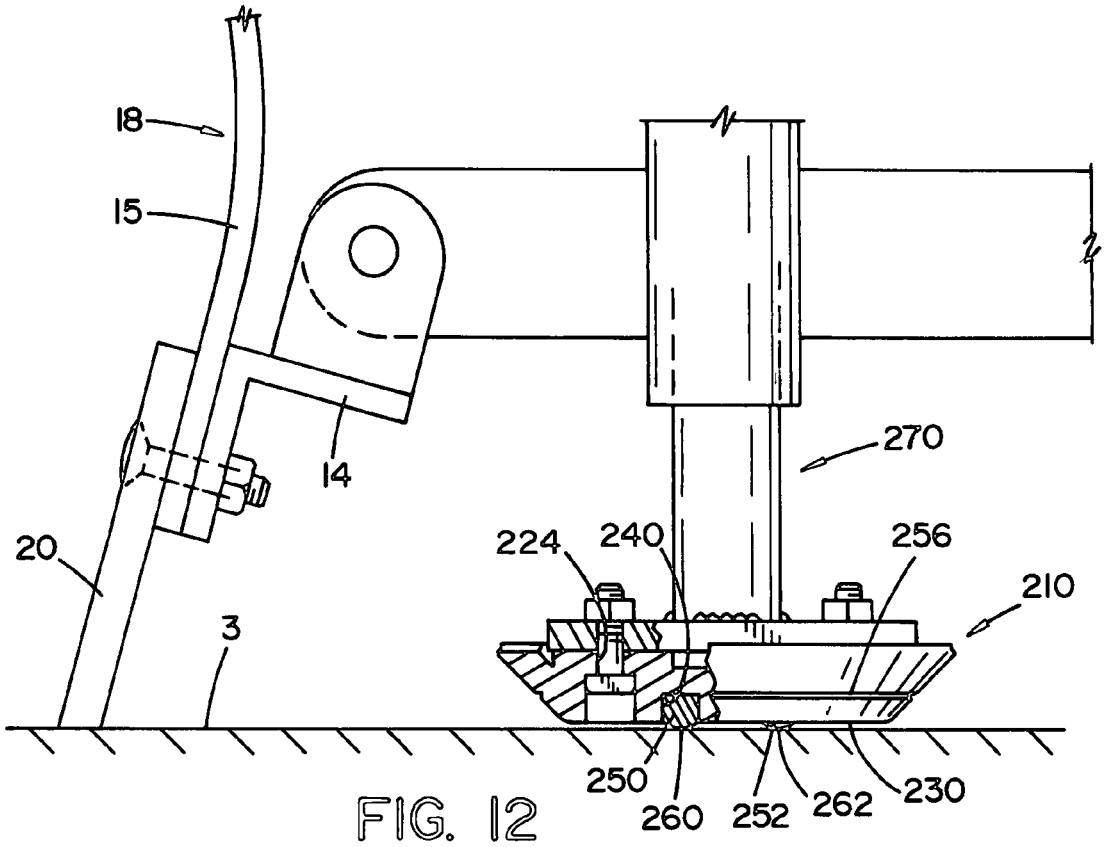
FIG. 12 is a side plan view of a snow plow blade and frame attachment equipped with a skid shoe wear resistor of the present disclosure according to a third embodiment.
Figure 13:
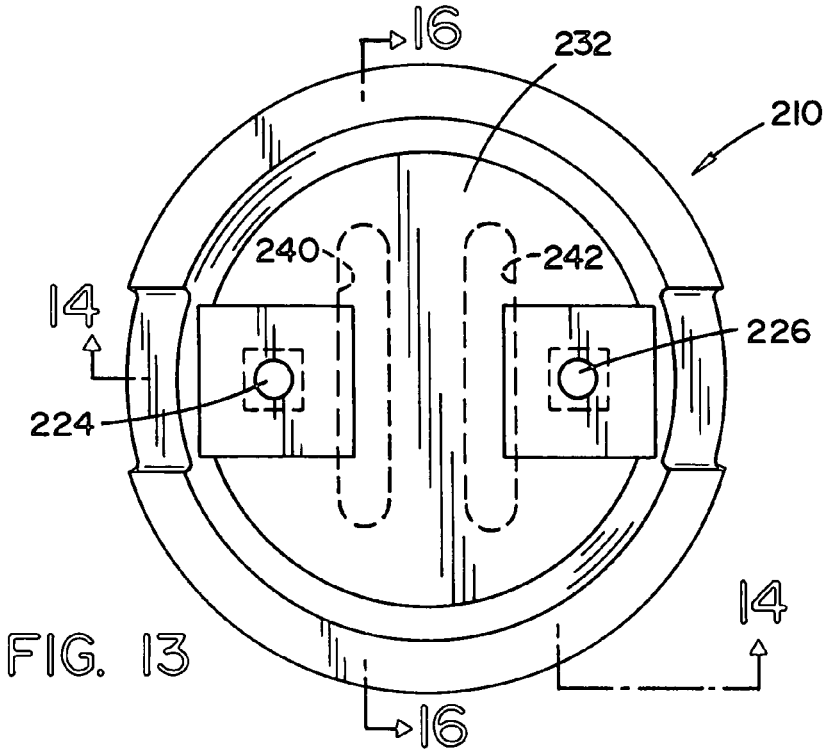
FIG. 13 is a top plan view of the skid shoe according to the third embodiment.

The expendable wear parts or shoes 210 are adapted for replaceable attachment to, for example, a snow plow mold board or snow plow mounting arrangement 270 (FIG. 12). The at least first cavity 240 can include an abrasion-resistant welding deposit 250 therein for extending the service life of the wear surface 230 of the wear part. The wear part can include the second cavity 242 substantially aligned with the first cavity 240. The second cavity 242 can include the abrasion-resistant welding deposit 252 therein for further extending the service life of the wear surface 230. The welding deposits can comprise the matrix structure as described above. The cavities 240, 242 can be refilled in order to extend the life of the wear part 210. In this manner, the weldments 250, 252 can be reconstituted before the wear surface 230 reaches the wear line 256. The first and second cavities 240, 242 can be substantially parallel to one another.

It is to be appreciated that skid shoe 210 includes a set of spaced apart mounting openings 224 and 226 such that shoe 210 may be mounted to the snow plow mounting frame 270. Other standard mounting hole spacings and arrangements are also within the scope of the present disclosure.

The welding deposits 250, 252 in the first and second cavities 240, 242 can overfill the cavities forming substantially parallel bulbous deposits 260, 262 extending outwardly from the wear surface 230 of the casting. The first and second cavities 240, 242 can be spaced from one another and run along the majority of the length of the wear surface 230 of the casting (refer to FIG. 15).

The wear part 210 can include a thickness 234 between the wear surface 230 and an upper surface 232 of the shoe 210. The first and second cavities 240, 242 can include a depth 243 wherein the depth is at least one half of the thickness 234 of the wear part 210.

In one exemplary shape, the essentially circular skid shoe 210, as shown in FIGS. 12-16, can be about 12 inches in circumference overall including a wear surface 230 having a circumference of about 8 inches. It is to be appreciated that other embodiments can take the form of other shapes and other dimensions.

When the wear parts comprise a plow skid shoe, a pair of skid shoes 10, 110, 210 are typically provided for attachment to opposite ends of a blade or opposing sides of a snow plow attachment frame 14, 170, 270 whereby the wear surface 30, 130, 230 of each plow skid shoe 10, 110, 210 is simultaneously in sliding engagement with a road surface 3 during use thereof. Thus, the pair of shoes 10, 110, 210 provide the majority of total wear surface when the plow vehicle is in use.

Figure 5:
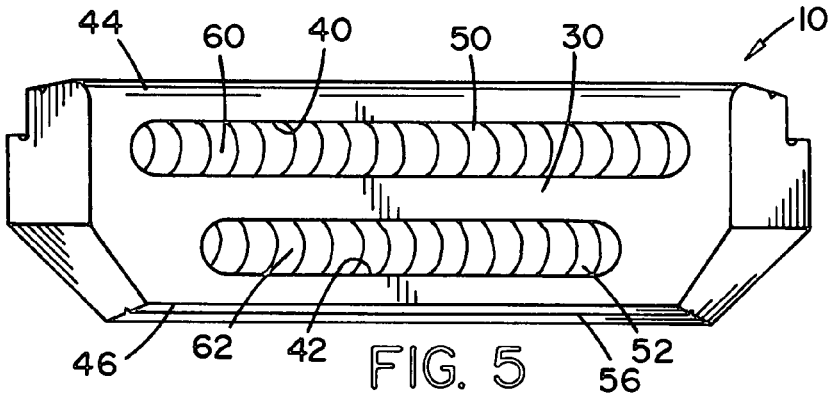
FIG. 5 is a bottom plan view of the skid shoe illustrating the spatial relationship between the wear surface and the wear resistors.
Figure 15:
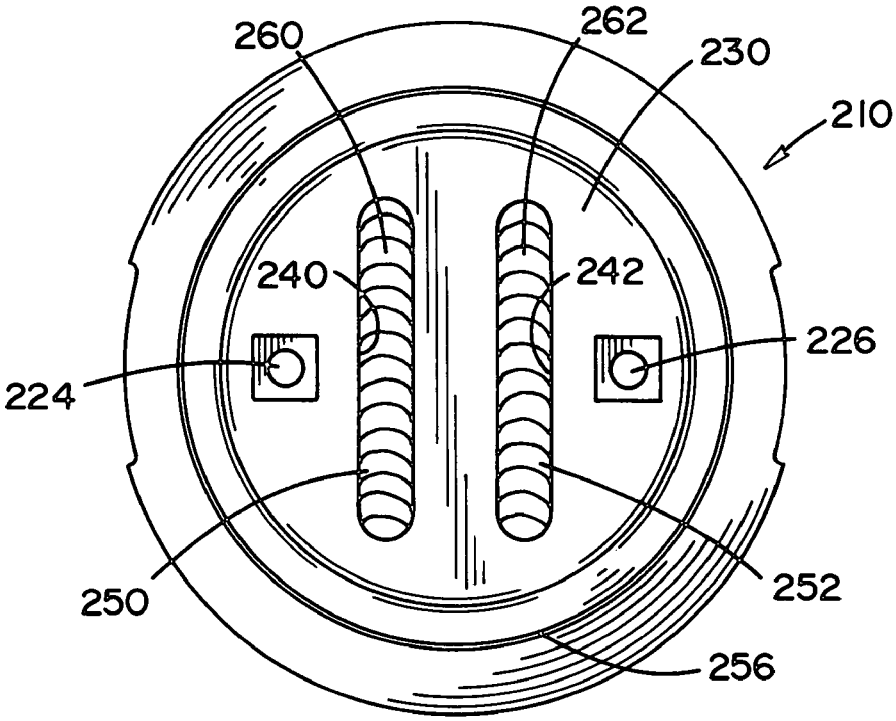
FIG. 15 is a bottom plan view of the skid shoe wear resistor illustrating the spatial relationship between the wear surface and the wear resistors; and, FIG. 16 is a cross sectional view of the skid shoe taken along line 16-16 of FIG. 13.
Figure 16:
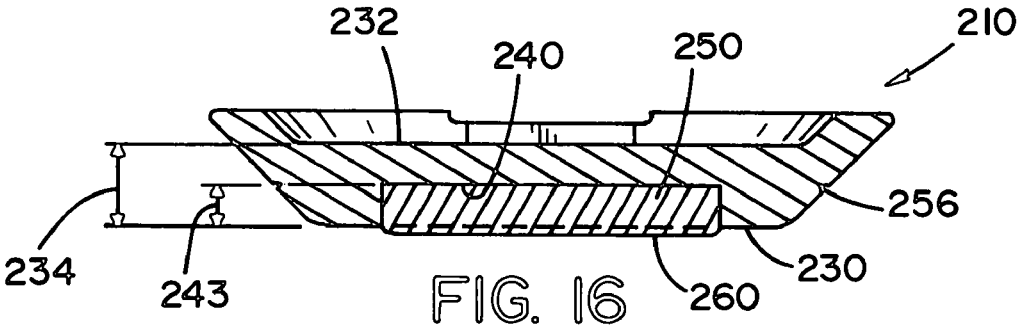

The wear part includes a direction of travel when an associated plow is in an engaged and use position. The deposits 50, 52, 150, 152, 250, 252 can be longitudinally aligned with, or transverse to, the direction of travel. The plurality of cavities 40, 42, 140, 142, 240, 242 can be spaced from one another and run along the majority of the length of the wear surface 30, 130, 230 of the castings (FIGS. 5, 10, 15).

The method of welding the deposits can include depositing the matrix layers one on top of another wherein each individual layer running along substantially the length of the cavity. It is to be appreciated that the weldments 50, 52, 150, 152, 250, 252 can be reconstituted prior to the wear surface reaching the wear line.

Although not illustrated, the present disclosure also relates to excavating and other agriculture tools such as revolving cutter head excavators for use in mines or dredgers. The wear surfaces can be, for example, on the cutting teeth or scrapers therefore.

Revolving cutter head excavators consist of a drive wheel that rotates around a shaft and is driven by a means of rotation.

The periphery of the revolving cutter head excavator has a series of buckets equipped with teeth arranged in directions that are essentially radial. Dredgers do not have buckets and their teeth are distributed around the periphery in a rotary ogival structure. Each tooth consists of a single-unit tooth body structure made of a mechanically resistant metal or alloy such as steel, having a fixing area to connect it to the bucket or the ogival structure and a working area to dig the soil. The working area is generally flat and shaped like a shovel and is bounded by a leading face that points in the direction of movement of the periphery of the wheel or ogival structure in the preferred direction of rotation and a trailing face or face opposite the leading face. The leading face and the trailing face are generally flat or slightly curved and are connected by a front tapered facet that defines a transverse cutting edge. If the tooth is mounted on the bucket or the ogival structure, the transverse cutting edge is essentially parallel to the axis of rotation of the assembly and the general plane formed by the tooth shovel or working area generally slants in the direction of the direction of movement of the tooth in the preferred direction of rotation.

During operation, part of the peripheral zone of the bucket or cutter cuts into the ground, the transverse cutting edge of the teeth bites into the ground and the leading face pushes up the material. This results in considerable wear of the transverse cutting edge and the leading face.

One common solution to increase the service life and the efficiency of the teeth is to hardface the external surface of the leading face and the tapered front facet in order to cover them with a coat of molten carbide by fusing a welding bead.

Although this process significantly increases the service life of the tooth, wear still occurs, relatively slowly at the start of use when the hard material still covers the front facet; wear then becomes much faster when the hard material that covers the front facet is itself damaged by wear. The tooth can only be used as long as the length of its working area has not reduced too extensively and this defines the maximum permissible area of wear of the tooth.

In particular, as soon as the front facet has lost its protective coating of hard material, wear becomes much faster despite the existence of a layer of hard material on the leading face of the tooth.

Dredger teeth with a composite structure are known consisting of a metal tooth body containing inserts of a hard anti-abrasion material. In document U.S. Pat. No. 3,805,423, a prefabricated insert is fitted in appropriate recesses in the metal tooth body where it is fixed by welding or brazing. The insert, in the embodiment shown in FIGS. 3 and 4, consists of two intermediate bars which each take up half the height of the tooth. Document U.S. Pat. No. 4,052,802 also describes providing a prefabricated insert and fitting it in the tooth body. The insert is sandwiched between the metal surface plates, between which it is assembled by brazing. Therefore the insert does not take up the entire height of the tooth. There is no suggestion in this document of replacing the metal plates by a material containing particles of a hard material.

In contrast to providing prefabricated inserts, the present disclosure, similar to the above description for skid shoes, provides for a steel casting with one or more cavities. The cavities can be transverse to the cutting edge of the teeth and extend along a majority of the length of the teeth. Each of the cavities can subsequently be filled with a carbide matrix by way of welding layers of deposits according to the detailed description provided above.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

I claim:

1. An expendable wear part adapted for replaceable attachment, comprising:

a wear part comprising a unified steel casting having a mounting surface and a wear surface;

said wear surface having at least a first casted cavity including a length extending along and integral with said wear surface;

said at least first cavity including an abrasion-resistant reconstitutable welding deposit therein whereby abrasion action on said wear surface is reduced by said deposit;

said deposit comprising a weldment material selected from the group consisting of chrome carbide, vanadium carbide, and tungsten carbide;

said weldment material having a higher hardness than said steel casting for extending the service life of said wear surface of said wear part;

said welding deposit in at least said first cavity initially overfills said cavity forming a substantially bulbous deposit extending outwardly from said wear surface of said casting;

said bulbous deposit having a surface area, wherein said bulbous deposit surface area extending initially in a co-linear arrangement with said wear surface and wherein said welding deposit extending co-planar with said wear surface at a time of reconstituting said weldment over substantially same said length; and, wherein substantially all of said deposit surface area exposed to the abrasive action.

2. The wear part in accordance with claim 1 further including a second cavity substantially aligned with said at least first cavity, said second cavity including said abrasion-resistant welding deposit therein.

3. The wear part in accordance with claim 2, wherein said first and said second cavities are substantially parallel to one another.

4. The wear part in accordance with claim 3, wherein said first and said second cavities are spaced from one another and run along the majority of the length of said wear surface of said casting.

5. The wear part in accordance with claim 4, wherein the wear part includes a thickness; and, said first and said second cavities include a depth wherein said depth is at least one half of said thickness of said wear part.

6. The wear part in accordance with claim 4, wherein the wear part includes a thickness; and, said first and said second cavities include a depth wherein said depth is substantially the same as said thickness of said wear part.

7. The wear part in accordance with claim 5, wherein said wear part comprises a plow shoe, a set of two said plow shoes are provided for attachment to the opposite ends of a snow plow attachment frame whereby said wear surface is in sliding engagement with a road surface during use thereof.

8. An expendable wear part adapted for replaceable attachment, comprising:

a wear part comprising a unified steel casting having a mounting surface and a wear surface;

said wear part including a direction of travel when in an engaged position;

said steel casting including a wear surface having a plurality of casted cavities extending along and integral with said wear surface;

said plurality of cavities each having an abrasion-resistant welding deposit therein;

said welding deposit having a higher hardness than said steel casting;

wherein said welding deposits in said plurality of cavities overfills the cavities forming substantially bulbous deposits adjacent to and extending outwardly from said wear surface of said casting, said deposits longitudinally aligned with said direction of travel; and, said plurality of cavities are spaced from one another and run along the majority of the length of said wear surface of said casting wherein substantially all of said deposit surface area is exposed to the abrasive action.

9. The wear part in accordance with claim 8, wherein said deposit comprising a weldment material selected from the group consisting of chrome carbide, vanadium carbide, and tungsten carbide.

10. The wear part in accordance with claim 9, wherein said plurality of cavities are substantially parallel to one another.

11. The wear part in accordance with claim 8, wherein the wear part includes a thickness; and, said plurality of cavities include a depth wherein said depth is at least one half of said thickness of said wear part.

12. The wear part in accordance with claim 8, wherein the wear part includes a thickness; and, said plurality of cavities include a depth wherein said depth is substantially the same as said thickness of said wear part.

13. The wear part in accordance with claim 11, wherein said wear part comprises a plow shoe whereby a set of two said plow shoes are provided for attachment to the opposite ends of a snow plow attachment frame for sliding engagement with a road surface.

14. A method for extending the life of an expendable wear part adapted for replaceable attachment, comprising:

casting a steel wear part having a plurality of casted cavities extending longitudinally along and integral with a wear surface of said wear part, said cavities including lengths aligned with a direction of travel of said wear part when said wear part is in an engaged and use position;

welding a series of abrasion resistant deposit layers in said cavities wherein said layers are spaced from one another and run along the majority of the length of said wear surface of said casting and wherein said deposit layers having a higher hardness than said steel casting wear part;

wherein said welding said deposit layers further include overfilling said cavities thereby forming bulbous deposits adjacent along and extending outwardly from said cavities of said wear surface;

wherein said wear part includes a thickness having a wear replacement line between said wear surface and a mounting surface;

wherein said wear line positioned at a predetermined useable limit of said wear part; and, reconstituting said deposit layers over substantially same said lengths before said wear surface reaches said wear line.

15. The method in accordance with claim 14, wherein said deposit layers forming substantially parallel bulbous deposits.

16. The method in accordance with claim 15, wherein said deposit layers comprising a weldment material selected from the group consisting of chrome carbide, vanadium carbide, and tungsten carbide.

17. The method in accordance with claim 15, wherein said welding further includes depositing said layers one on top of another wherein each individual layer running along substantially the length of said cavity.

18. A method for extending the life of an expendable wear part adapted for replaceable attachment, comprising:

casting a unified steel wear part having a plurality of casted cavities extending longitudinally along a wear surface of said wear part, said cavities aligned with a direction of abrasive travel of said wear part when said wear part is in an engaged and use position; and, welding a series of abrasion resistant deposit layers in said cavities wherein said layers are spaced from one another and run along the majority of the length of said wear surface of said casting and wherein said deposit layers having a higher hardness than said steel casting wear part;

said welding said deposit layers further include overfilling said cavities thereby forming substantially parallel bulbous deposits adjacent along and extending outwardly from said wear surface of said casting in a non-coplanar arrangement;

wherein said deposit layers wear from said non-coplanar arrangement with said wear surface to a co-planar arrangement with the majority of said wear surface; and, reconstituting said deposit layers from said co-planar arrangement with said wear surface to another non-coplanar arrangement with said wear surface.

19. An expendable wear part adapted for replaceable attachment, comprising:

a wear part comprising a unified steel casting having a mounting surface and a wear surface;

said wear part including a direction of travel when in an engaged position;

said steel casting including a wear surface having a plurality of casted cavities extending along said wear surface;

said plurality of cavities each having an abrasion-resistant welding deposit therein;

said welding deposit having a higher hardness than said steel casting;

wherein said welding deposits in said plurality of cavities overfills the cavities forming substantially parallel bulbous deposits adjacent to and extending outwardly from said wear surface of said casting, said deposits longitudinally aligned with said direction of travel;

said plurality of cavities are spaced from one another and run along the majority of the length of said wear surface of said casting; and, said welding deposits comprise initially a majority of said wear surface and then subsequently wear to a minority of said wear surface.

20. An expendable wear part adapted for replaceable attachment, comprising:

a wear part comprising a singular unified steel casting component having a mounting surface and a wear surface;

said steel casting including a wear surface having a plurality of casted cavities extending along said wear surface;

said plurality of cavities each having an abrasion-resistant welding deposit therein;

said welding deposit having a higher hardness than said steel casting;

wherein said welding deposits in said plurality of cavities overfills the cavities forming bulbous deposits adjacent along and extending outwardly from said wear surface of said casting;

said plurality of cavities are spaced from one another and run along the majority of the length of said wear surface of said casting; and, initially said wear surface consists substantially of said welding deposits and then consequently, after wear, said welding deposits comprise a minority of said wear surface.

* * * * *